US007378211B2

(12) United States Patent
Angra et al.

(10) Patent No.: US 7,378,211 B2
(45) Date of Patent: May 27, 2008

(54) CARRIER AND DEVELOPER COMPOSITIONS

(75) Inventors: Padam K. Angra, Penfield, NY (US); Michael L. Grande, Palmyra, NY (US); Zhaoyi M. Masucci, Penfield, NY (US); Joseph H. Rowe, Webster, NY (US); John S. Walters, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 390 days.

(21) Appl. No.: 11/204,602

(22) Filed: Aug. 15, 2005

(65) Prior Publication Data

US 2007/0037084 A1 Feb. 15, 2007

(51) Int. Cl.
*G03G 9/107* (2006.01)

(52) U.S. Cl. ..... 430/111.32; 430/111.41; 399/262

(58) Field of Classification Search ..... 430/109.3, 430/111.32, 111.41; 399/262
See application file for complete search history.

(56) References Cited

U.S. PATENT DOCUMENTS 4,513,074 A 4/1985 Nash et al.
5,482,805 A 1/1996 Grande et al.
5,486,443 A 1/1996 Grande et al.
5,518,855 A 5/1996 Creatura et al.
5,567,562 A 10/1996 Creatura et al.
5,700,615 A 12/1997 Silence et al.
5,744,275 A 4/1998 Duggan et al.
5,945,244 A 8/1999 Barbetta et al.
5,968,703 A 10/1999 Maniar et al.
6,051,354 A 4/2000 Veregin et al.
6,132,863 A 10/2000 Song et al.
6,245,474 B1 * 6/2001 Hsu et al. ..... 430/110.4
6,764,799 B2 7/2004 Skorokhod et al.

* cited by examiner

*Primary Examiner*—John L Goodrow
(74) *Attorney, Agent, or Firm*—Annette L. Bade

(57) ABSTRACT

A carrier composition having magnetite with a diameter of from about 80 microns to about 150 microns, and wherein the carrier has a conductivity of from about $10^{-8}$ to about $10^{-11}$ (ohms-cm)$^{-1}$ and a carrier breakdown voltage of from about 20 to about 200 volts, and a developer composition with toner and this carrier composition, and also including a developer housing apparatus and an electrostatographic apparatus comprising the developer housing apparatus.

14 Claims, No Drawings

CARRIER AND DEVELOPER COMPOSITIONS

BACKGROUND

Herein disclosed are carrier and developer compositions thereof, and more specifically the carrier comprises magnetite having, in embodiments, a specific diameter, and the carrier has a specific conductivity and carrier breakdown voltage. Also, in embodiments, a developer is included. The carriers and developer compositions described herein are useful in a number of known electrostatographic imaging and printing systems, especially in magnetic image character recognition processes (MICR).

Existing developer tested in a MICR machine exhibited poor MICR characteristics, including poor print characteristics. In addition, known developers have been shown to exhibit poor tribo and $A_t$ stability. Moreover, known developer have shown unacceptable developer life. In addition, known carriers and developers have demonstrated unacceptable conductivity.

U.S. Pat. No. 6,764,799 discloses carrier conductivities of from about $10^{31\ 2}$ to about $10^{-15}$, or from about $10^{-11}$ to about $10^{-13}$ S/cm.

U.S. Pat. No. 4,513,074 discloses developer compositions having carrier conductivities of from about $10^{-9}$ to about $10^{-12}$ ohm-cm$^{-1}$.

U.S. Pat. No. 5,518,855 discloses carrier conductivity of from about $10^{-17}$ to about $10^{-6}$, or $10^{-14}$ to about $10^{-6}$ (ohms-cm)$^{-1}$.

U.S. Pat. No. 5,567,562 discloses carrier conductivity of from about $10^{-6}$ to about $10^{-14}$ (ohms-cm)$^{-1}$.

U.S. Pat. No. 5,567,562 discloses carrier conductivity of from about $10^{-6}$ to about $10^{-15}$, from about $10^{-9}$ to about $10^{-15}$, and developer conductivities of from about $10^{-6}$ to about $10^{-15}$ (ohms-cm)$^{-1}$.

U.S. Pat. No. 5,700,615 discloses carrier conductivity of from about $10^{-9}$ to about $10^{-17}$.

U.S. Pat. No. 5,744,275 discloses carrier conductivity of from about $10^{-9}$ to about $10^{-17}$.

U.S. Pat. No. 5,945,244 discloses developer conductivity of from about $10^{-6}$ to about $10^{-17}$, from about $10^{-10}$ to about $10^{-6}$, and from about $10^{-8}$ to about $10^{-6}$ (ohms-cm)$^{-1}$.

U.S. Pat. No. 5,968,703 discloses developer conductivity of from about $10^{-12}$ to about $10^{-7}$ (ohms-cm)$^{-1}$ and carrier conductivity of about $10^{-10}$, or less than $10^{-14}$ (ohms-cm)$^{-1}$.

U.S. Pat. No. 6,051,354 discloses carrier conductivity of from about $10^{-10}$ to about $10^{-7}$, from about $10^{-6}$ to about $10^{-17}$, and about $10^{-6}$ to about $10^{-8}$.

U.S. Pat. No. 5,482,805 teaches a toner consisting essentially of resin particles, magnetite pigment, carbon black pigment, rhodamine charge additive, wax, and a surface mixture of aluminum oxide, strontium titanate and polyvinylidene fluoride; and wherein said resin particles are present in an amount of from about 50 to about 90 weight percent, said magnetite is present in an amount of from about 25 to about 40 percent, said carbon black is present in an amount of from about 1 to about 5 weight percent, said wax is present in an amount of from about 3 to about 15 weight percent, and said aluminum oxide, strontium titanate and polyvinylidene fluoride are each present in an amount of from about 0.5 to about 2 weight percent.

U.S. Pat. No. 5,486,443 discloses the toner of 5,482,805, except that aluminum oxide is replaced with silica.

Therefore, there is a need for carriers and developers that exhibit superior MICR characteristics, including improved print characteristics. In addition, there is a need for carriers and developers, which will exhibit improved tribo and $A_t$ stability. Moreover, there is a need for a carrier and developer having superior developer life. In addition, there is a need for toners that provide acceptable MICR characteristics.

SUMMARY

Embodiments include a carrier composition comprising magnetite having a diameter of from about 80 microns to about 150 microns, and wherein the carrier has a carrier conductivity of from about $10^{-8}$ to about $10^{-11}$ (ohms-cm)$^{-1}$ and a carrier breakdown voltage of from about 20 to about 200 volts.

In addition, embodiments include a developer composition comprising a toner and a carrier, wherein the carrier comprises magnetite having a diameter of from about 80 microns to about 150 microns, and wherein the carrier has a carrier conductivity of from about $10^{-8}$ to about $10^{-11}$ (ohms-cm)$^{-1}$ and a carrier breakdown voltage of about 20 to 200 volts.

Embodiments further include a developer housing apparatus including therein a developer composition comprising a toner and a carrier, wherein the carrier comprises magnetite having a diameter of from about 80 microns to about 150 microns, and wherein the carrier has a carrier conductivity of from about $10^{-8}$ to about $10^{-11}$ (ohms-cm)$^{-1}$ and having a carrier breakdown voltage of from about 20 to about 200 volts.

Embodiments also include an electrostatographic apparatus comprising a developer housing apparatus including therein a developer material composition comprising a toner and a carrier, wherein the carrier comprises magnetite having a diameter of from about 80 microns to about 150 microns, and wherein the carrier has a carrier conductivity of from about $10^{-8}$ to about $10^{-11}$ (ohms-cm)$^{-1}$ and a carrier breakdown voltage of from about 20 to about 200 volts.

DETAILED DESCRIPTION

Disclosed herein are carrier compositions, including a developer with carrier and toner, wherein the carrier, in embodiments, comprises magnetite having a specific diameter, and wherein the carrier, in embodiments has a specific carrier conductivity and carrier breakdown voltage. The carriers, and developers thereof described herein, in embodiments, exhibit improved MICR characteristics, including improved print characteristics. In addition, the carriers and developers herein, in embodiments, exhibit improved tribo and $A_t$ stability. Moreover, the carriers and developers herein, in embodiments, have superior developer life. In addition, the carriers herein, in embodiments, provide acceptable MICR characteristics (for example, in embodiments, reject rates are less than half of a percent).

Electrostatographic, electrophotographic, xerographic, or the like processes are known. The process includes the formation of an electrostatic latent image on a photoreceptor of other imaging member, followed by development of the latent image with a developer material (including toner, or toner and carrier), and subsequent transfer of the developed image to a suitable copy or print substrate, such as paper or a transparency, or the like. Developer particles are chosen depending on the development system used. Developer compositions are also chosen for their triboelectric charging values to enable formation of the developed images having high quality and excellent resolution. Developer can be one-component (toner) or two-component (toner and carrier). In two-component systems, the carrier particles are chosen to charge the toner particles.

In embodiments, the toners comprise resin particles, magnetite particles, waxes, charge enhancing additives, and surface additives.

More specifically, the toner compositions comprise resins, such as styrene methacrylates, styrene acrylates, styrene butadienes, polyesters, and the like, styrene butadienes, low molecular weight waxes, for example from about 500 to about 20,000 Mw, or from about 1,000 to about 7,000 Mw (weight average molecular weight), and the like. In embodiments, the resin is styrene butadiene. The resin particles can be present in various effective amounts, such as from about 50 to about 75, or from about 60 to about 70, or about 62 weight percent, include styrene butadiene copolymers, such as PLIOTONE, and wherein the styrene is present, for example, in an amount of from about 60 to about 95 weight percent, and the butadiene is present in an amount of from about 5 to about 30 weight percent, or from about 80 to about 90 weight percent of styrene and from about 10 to about 20 weight percent of butadiene. These resins provide toners that exhibit, for example, no or minimal toner developed vinyl offset.

Numerous suitable pigments can be selected primarily for enhancing the black color of the magnetites present. These pigments include carbon, blacks, such as REGAL 330, and the like available from Cabot Corporation and Columbian Chemicals. The carbon black pigment is present in an effective amount, such as from about 1 percent by weight to about 5, or from about 1 to about 3 weight percent based on the total weight of the toner components.

The toner may also comprise magnetites, such as acicular, octahedral, spheroidal or acicular magnetites. The magnetite include a mixture of iron oxides (FeO, $Fe_2O_3$). The magnetites are present in the toner composition in an amount of from about 20 to about 40, or from about 24 to about 26, or from about 25 to about 26 percent by weight. The magnetic remenance of the toner is from about 7 to about 14, or from about 8 to about 13, or from about 9 to about 12.5, or from about 9 to about 10 emu/gram of toner when measured at 1,000 Oersteds field strength in a vibration magnetometer, such as VSM 155, or comparable device. Also, surface treated magnetites, such as those available from Toda Kogyo Inc., can be selected. These treated magnetites can contain coatings, such as phosphate, titanium or silane coupling agent components, in an amount, for example, of from about 0.5 to about 2 weight percent. Specific examples of untreated and treated magnetites that can be selected include, Magnox Corporation MAGNOX B-350 and B-353; ISK magnetics MO-4232, HX-3204, MCX-2096, MO-7029 and MO-4431%, or Toda Kogyo Corporation MTA-740 or MTA-230. Examples of surface treated magnetites include 7029 and the 4431. In embodiments of the present invention, the magnetite is Magnox B-353.

Waxes with a molecular weight of from about 500 to about 20,000, and include polyethylene, polypropylene, and the like, and paraffin waxes, and the like. Examples of specific waxes include crystalline polyethylene wax with a weight average molecular weight of from about 1,000 to about 3,000, for example POLYWAX 1,000, 2,000 and 3,000 as obtained from the Petrolite Corporation. These waxes are present in various effective amounts, such as for example from about 3 to about 9 percent, or from about 3 to about 5 percent, or from about 4 to about 5 percent. A specific example of a suitable wax is a highly crystalline polyethylene wax with a specific gravity of equal to or greater than 0.93, and which waxes are available from Petrolite Corporation.

The toner may comprise a charge control additive. An example of a suitable charge control additive is one comprising an insoluble salt of RHODAMINE 6G, benzoic acid, 2-[6-(ethylamino)-3-(ethylimino)-3H-xanthen-9-yl] ethyl ester.

The rhodamine salt charge control additives can be obtained from BASF as FANAL PINK 4830, 4680, 5460, 5480, and the like. The charge additive is present in an amount of from about 0.5 to about 2, or from about 0.7 to about 1 weight percent. In embodiments, the charge control additive is FANAL PINK 4830 wherein X is silicomolybdate.

The external surface additive mixture includes colloidal silicas, such as AEROSIL, or treated silicas, strontium titanate, and polyvinylidene fluoride. Each of the additives is present on the toner in amounts of from about 0.4 to about 2.0, or from about 0.45 to about 1 weight percent. Examples include Wacker HDK 2050 EP, strontium titanate such as $SrTiO_3$ Code No. 218 obtained from Ferro Corporation, and with an average diameter size of 1.3 microns as measured by Coulter Counter; and polyvinylidene fluoride, such as KYNAR 210F, or 310F available from Autochem.

The toner compositions are prepared by known melt blending processes, or by extrusion are usually jetted and classified subsequent to preparation to enable toner particles with an average volume diameter of from about 5 to about 12 microns, or from about 8 to about 10 microns, or from about 9 to about 9.5 microns, or about 9.25 microns.

For developer compositions, toner particles are mixed with carrier particles, and in embodiments, carriers that are capable of triboelectrically assuming an opposite polarity to that of the toner composition. Accordingly, the carrier particles can be selected to be of a negative polarity enabling the toner particles, which are positively charged, to adhere to and surround the carrier particles. Illustrative examples of carrier particles include magnetite, iron powder, steel, nickel, iron, ferrites, including copper zinc ferrites, magnetic iron oxides, and the like. In embodiments, the carrier is XM-911 (120 micron magnetite with a coating and may contain other unknown components) from Kanto Denka Kogyo of Japan (KDK). The selected carrier particles can be used with or without a coating.

Furthermore, the diameter of the carrier particles, which can be nonspherical in shape, is generally from about 80 microns to about 150, or from about 100 to about 140 microns, or from about 110 to about 130, or from about 112 to about 120 microns, or from about 113.9 to about 115 microns as measured by a Malvern Instruments MasterSizer X.

Furthermore, the breakdown voltage of the carrier particles as measured by a Xerox Corporation VB/Conductivity Autometer, is generally from about 20 to about 200, or from about 55 to about 145 microns, or from about 82 to about 124 volts.

The carrier component can be mixed with the toner composition in various suitable combinations, such as for example from about 2 to about 6 parts, or from about 3 to about 5 parts by weight of toner per about 100 parts by weight of carrier.

The carrier conductivities are from about $10^{-8}$ to about $10^{-11}$, or from about $10^{-9}$ to about $10^{-11}$, or from about $10^{-10}$ to about $10^{-11}$ $(\text{ohms-cm})^{-1}$ as measured by a Xerox Corporation VB/Conductivity Autometer at 10 volts.

The developer herein has developer flow as measured on a Hall flow meter of from about 1.54 to about 2.14, or from about 1.69 to about 1.99, or from about 1.74 to about 1.94 gram/sec.

The developer conductivity is from about $10^{-14}$ to about $10^{-10}$, or from about $10^{-14}$ to about $10^{-13}$, or from about $3.31 \times 10^{-14}$ to about $1.91 \times 10^{-14}$ (ohms-cm)$^{-1}$ as measured by a xerox Corporation VB/Conductivity Ahtometer at 10 volts.

The following Examples are being supplied to further define various species herein, it being noted that these Examples are intended to illustrate and not limit the scope herein. Parts and percentages are by weight unless otherwise indicated.

EXAMPLES

Example 1

Preparation of a Toner

There was prepared a toner by melt blending in a Banbury apparatus and rubber mill, followed by mechanical attrition, which toner contains 61.75 percent by weight of a styrene butadiene copolymer containing 90 percent by weight of styrene and 10 percent by weight of butadiene, obtained from Goodyear Chemicals Corporation, as PLIOTONE, and 26 percent by weight of the acicular magnetite MAGNOX B-353, the highly crystalline polyethylene wax POLYWAX 2000 in amount of 5 percent by weight, 1.0 percent by weight of the charge control agent FANAL PINK 4830, the phosphomolybdate salt of RHODAMINE obtained from BASF, and 3 percent by weight of REGAL 330 carbon black obtained from Cabot Corporation. Micronization in an AFG Fluidizer Bed Jet Mill enabled toner particles with a volume median diameter of 9.25 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 9.25 microns.

Subsequently, there was added to the resulting toner particles surface by blending in a Lodige blender 1.0 percent by weight of WackerChemie GmbH HDK H2050 EP hydrophobic positively charging silica, 1 percent by weight of strontium titanate obtained from Ferro Corporation (Code 218), and 0.45 percent by weight of polyvinylidene fluoride, KYNAR 201 obtained from Atochem Inc. of North America.

Example 2

Preparation of Developer Composition

There was prepared a developer composition by mixing the aforementioned formulated toner composition at 4.0 percent toner concentration, that is 4 parts by weight of toner per 100 parts by weight of carrier with carrier (120 micron magnetite).

Triboelectric charging of the toner in the aforementioned developer was determined by shaking in a paint mixer 100 grams of the developer in an 8 ounce jar for fifteen minutes, then measuring the charge on the toner in a Faraday Cage apparatus. The charge on the toner was determined to be a positive 10 microCoulomb/gram. To the developer was then added an additional 2.0 weight percent of toner and the developer was shaken for fifteen seconds after which the charge distribution of the toner was measured in a Xerox Corporation toner charge spectrograph apparatus. The charge spectrum exhibited a single narrow peak indicating that the added 2.0 weight percent of uncharged toner had admixed with the incumbent toner in 15 seconds or less. The toner average charge distribution (Q/D) was 0.554 fC/micron, wherein Q is the charge on the toner particles, or particle and D is the diameter of the particle, or particles. The width of the distribution as determined by the standard deviation of Q/D divided by Q/D, was 0.684.

Example 3

Testing of the Developer Composition in Machine Environment

The aforementioned developer composition was used to develop latent images generated in a Xerox Corporation Continuous Feed DP525/1050 MX Printer apparatus, to a paper substrate and the images were fused to paper for 1.4 million copies, each with from 4 to 30 percent area coverage. Furthermore, this test was conducted under temperature and humidity conditions of 60 to 80° F., and 20 to 80 percent relative humidity. The developer charging properties ($A_t$) remained in about 30 to about 50 range, and essentially constant in any given environment throughout the test, that is for 1.4 million copies, as determined by periodic measurements of toner triboelectric charge and toner concentration in the developer. The values of, for example, $A_t$ remained at about 30 to about 50, throughout this test as determined from the following calculation, that is the product of one plus the toner concentration (TC) multiplied by the charge Q/M, $A_t$=(1+TC)*Q/M. For example, the charge of about 8 microCoulombs/gram and toner concentration of about 4 percent would give $A_t$ value of about 40.

The fused images, that is personal checks with magnetic characters thereon, were of excellent quality, that is the check characters had high optical densities of from about 1.0 to about 1.3 (solid area image optical density) as measured on a Macbeth Densitometer and very low development of toner in background areas, that is minimum background deposits. Periodic visual microscopic inspection of the photoreceptor indicated no evidence of toner impacting onto the photoreceptor, such as in small streaks of one millimeter or less, that is there was an absence of undesirable comets for 1.4 million copies. Examination of the Xerox Corporation test printer cleaning subsystem indicated a lack of excessive wear of its components.

When 500 checks prepared from the aforementioned developer were passed through an IBM 3890 reader/sorter, toner offsetting to the protective foils on the write and read heads was absent as evidenced by visual microscopic inspection, and there was no image smearing on the checks. These checks were repeatedly passed through the IBM 3890 for an additional 19 passes after which, upon inspection of the protective foil, there was evidence of only slight contamination.

Other modifications may occur to those skilled in the art subsequent to a review of the present application, and these modifications, including equivalents thereof, are intended to be included within the scope of the present invention.

What is claimed is:

1. A developer composition comprising a toner and a carrier, wherein said carrier comprises magnetite having a diameter of from about 80 microns to about 150 microns, and wherein said carrier has a carrier conductivity of from about $10^{-8}$ to about $10^{-11}$ (ohms-cm)$^{-1}$ and a carrier breakdown voltage of about 55 to about 145 volts.

2. The developer composition in accordance with claim 1, wherein said toner comprises a styrene butadiene resin.

3. The developer composition in accordance with claim 1, wherein said carrier and said toner are present in an amount of from about 2 to about 6 parts by weight of toner per about 100 parts by weight of carrier.

4. The developer composition in accordance with claim 1, wherein said toner has an average volume diameter of from about 5 to about 12 microns.

5. The developer composition in accordance with claim 4, wherein said average volume diameter is from about 8 to about 10 microns.

6. The developer composition in accordance with claim 5, wherein said average volume diameter is from about 9 to about 9.5 microns.

7. The developer composition in accordance with claim 1, wherein said toner has a magnetic remanence of from about 7 to about 14 emu/gram.

8. The developer composition in accordance with claim 7, wherein said magnetic remanence is from about 8 to about 13 emu/gram.

9. The developer composition in accordance with claim 1, wherein said developer has a developer flow of from about 1.54 to about 2.14 gram/sec.

10. The developer composition in accordance with claim 9, wherein said developer flow is from about 1.69 to about 1.99 gram/sec.

11. The developer in accordance with claim 1, wherein said developer has a developer conductivity of from about $10^{-14}$ to about $10^{-10}$ (ohms-cm)$^{-1}$.

12. The developer in accordance with claim 11, wherein said developer conductivity is from about $10^{-14}$ to about $10^{-13}$ (ohms-cm)$^{-1}$.

13. A developer housing apparatus including therein a developer composition comprising a toner and a carrier, wherein said carrier comprises magnetite having a diameter of from about 80 microns to about 150 microns, and wherein said carrier has a carrier conductivity of from about $10^{-8}$ to about $10^{-11}$ (ohms-cm)$^{-1}$ and a carrier breakdown voltage of from about 55 to about 145 volts.

14. An electrostatographic apparatus comprising a developer housing apparatus including therein a developer composition comprising a toner and a carrier, wherein said carrier comprises magnetite having a diameter of from about 80 microns to about 150 microns, and wherein said carrier has a carrier conductivity of from about $10^{-8}$ to about $10^{-11}$ (ohms-cm)$^{-1}$ and a carrier breakdown voltage of from about 55 to about 145 volts.

* * * * *